US007682465B2

(12) United States Patent
Anderson et al.

(10) Patent No.: US 7,682,465 B2
(45) Date of Patent: Mar. 23, 2010

(54) SLIDING TINE ASSEMBLY FOR A DISHWASHER

(75) Inventors: Randy Anderson, Chicago, IL (US); Heather Hagans, Jackson, TN (US); Kristen K. Hedstrom, Orlando, FL (US); Mark E. Palm, Davie, FL (US); Jeffrey N. Williams, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 239 days.

(21) Appl. No.: 11/707,051

(22) Filed: Feb. 16, 2007

(65) Prior Publication Data

US 2007/0247039 A1 Oct. 25, 2007

Related U.S. Application Data

(60) Provisional application No. 60/793,250, filed on Apr. 20, 2006.

(51) Int. Cl.
*A47B 57/00* (2006.01)

(52) U.S. Cl. ..... 134/56 D; 134/57 D; 134/58 D; 211/41.4; 211/41.8; 211/41.9; 312/228.1

(58) Field of Classification Search ..... 211/41, 211/175, 41.1, 41.2, 41.3, 41.4, 41.5, 41.6, 211/41.7, 41.8, 41.9; 312/228.1, 228; 134/56 D, 134/57 D, 58 D
See application file for complete search history.

(56) References Cited

U.S. PATENT DOCUMENTS

| | | | | |
|---|---|---|---|---|
| 2,804,213 | A | 8/1957 | Fox et al | |
| 2,971,668 | A | 2/1961 | Peglow | |
| 3,433,363 | A * | 3/1969 | Clearman et al. | 211/41.8 |
| 3,451,556 | A | 6/1969 | Macoicz | |
| 3,752,322 | A | 8/1973 | Fiocca et al. | |
| 4,046,261 | A | 9/1977 | Yake | |
| 4,592,471 | A | 6/1986 | Bross | |
| 4,606,464 | A | 8/1986 | Jordan et al. | |
| 4,917,248 | A * | 4/1990 | Friskney | 211/41.8 |
| 5,158,185 | A * | 10/1992 | Michael et al. | 211/41.8 |
| 5,351,837 | A | 10/1994 | Smith | |
| 5,601,195 | A | 2/1997 | Finola et al. | |
| 2006/0108298 | A1 * | 5/2006 | Kim | 211/41.8 |
| 2006/0254993 | A1 * | 11/2006 | Lee | 211/41.9 |
| 2006/0254994 | A1 * | 11/2006 | Lim | 211/41.9 |

* cited by examiner

*Primary Examiner*—Joseph L Perrin
*Assistant Examiner*—Benjamin Osterhout
(74) *Attorney, Agent, or Firm*—John W. Morrison; Diederiks & Whitelaw PLC

(57) ABSTRACT

A dishwasher includes a tub defining a washing chamber within which is arranged a dishrack having provided thereon an adjustable tine row assembly. The dishrack includes a base portion formed by a first plurality of spaced support members, and a second plurality of spaced support members that extend generally perpendicularly to the first plurality of spaced support members. The first and second plurality of spaced support members form a lattice work that defines the base portion. The tine row assembly includes a first tine row element, a second tine row element and a slider element that interconnects the first and second tine row elements with at least one of the first plurality of spaced support members. In this manner, the first and second tine row elements are selectively shiftable along the base portion providing a consumer with a greater degree of flexibility when loading/arranging dishware on the dishrack.

20 Claims, 6 Drawing Sheets

SLIDING TINE ASSEMBLY FOR A DISHWASHER

CROSS-REFERENCE TO RELATED APPLICATION

The present application claims the benefit of U.S. Provisional Patent Application Ser. No. 60/793,250 filed Apr. 20, 2006 entitled "Sliding Tine Assembly For a Dishwasher."

BACKGROUND OF THE INVENTION

1. Field of the Invention

The present invention pertains to the art of dishwashers and, more particularly, to a sliding tine assembly provided on a dishwasher dishrack.

2. Discussion of the Prior Art

In general, domestic dishwashers include at least one dishrack for supporting items, such as dishware, glassware, kitchen utensils, pots pans and the like, to be washed. The dishrack typically includes a plurality of tines arranged in rows to aid in organizing the dishware. As tines that are arranged to support plates often times cannot accommodate larger bowls or pots, the spacing between the rows and the tines is varied so as to accommodate various size dishware.

In order to provide greater flexibility in arranging dishware, several manufacturers have developed adjustable tine systems. Adjustable tine systems allow a consumer to alter a spacing between adjacent tines in a particular tine row in order to accommodate various sized/shaped dishware. In one typical arrangement, the adjustable tine system includes first and second interconnected tine rows that are arranged perpendicular to one another. Tines in the first tine row are spaced differently than the tines in the second tine row. To select a desired spacing, the consumer need simply rotate the tine system such that either the first or second tine row points upward from the dishrack. The tine system is then locked in place through, for example, a snap-fit arrangement.

While the above described system provides some degree of flexibility, arranging larger items on the dishrack also affects spacing between tine rows. That is, while the spacing between adjacent tines is increased to accommodate larger items, the spacing between adjacent tine rows remains unchanged. Thus, when placing a large item onto the dishrack, it becomes difficult to arrange additional items alongside the larger item.

Based on the above, despite the presence of adjustable tine systems in the prior art, there exists a need for a sliding tine system. More specifically, there exists a need for a sliding tine system that is selectively shifted relative to a dishrack to alter a spacing between adjacent tine rows to provide a consumer with a still greater degree of flexibility when loading dishware into a dishwasher.

SUMMARY OF THE INVENTION

The present invention is directed to a dishwasher including a tub defining a washing chamber within which is arranged a dishrack having provided thereon an adjustable tine row assembly. The dishrack includes a base portion formed by a first plurality of spaced support members and a second plurality of spaced support members that extend generally perpendicularly to the first plurality of spaced support members. The first and second plurality of spaced support members form a latticework that defines the base portion. In accordance with the invention, the tine row assembly includes a first tine row element, a second tine row element and a slider element that interconnects the first and second tine row elements with the dishrack. In this manner, the first and second tine row elements are selectively shiftable along the base portion to provide a consumer with a greater degree of flexibility when loading/arranging dishware on the dishrack.

In accordance with one aspect of the invention, each of the first and second tine row elements includes a first end portion, a second end portion and an intermediate portion. A connecting member joins the first and second tine row elements at the intermediate portion. The slider element is attached to each of the intermediate portions adjacent the connecting member. The slider element is slidably secured to at least one of the first plurality of spaced support members. With this arrangement the first and second tine row elements can be selectably shifted, in unison, along the base portion. In this manner, a spacing between the tine row assembly and adjacent tine rows can be easily adjusted to accommodate various sized/shaped dishware.

In accordance with another aspect of the invention, the first and second end portions of each of the first and second tine row elements are joined by respective first and second connecting members. With this arrangement, the slider element includes a slider or rack clip, as well as a tine clip. The tine clip is connected to each of the first and second tine row elements. The slider clip is connected to one of the first plurality of spaced support members and the tine clip. This construction slidably mounts the first and second tine row elements to the base portion. Preferably, the tine row assembly includes first and second slider elements having respective first and second tine clips that are connected to the first and second tine row elements adjacent corresponding ones of the first and second end portions. In addition, the tine row assembly includes first and second slider clips that slidably connect respective ones of the first and second tine clips to the base portion.

In accordance with the most preferred form of the invention, the tine row assembly includes a rail member that is connected to the base portion between adjacent ones of the second plurality of spaced support members. The rail member includes a first end portion, a second end portion and an intermediate portion provided with a channel. With this arrangement, the first connecting members rests within the channel and the second connecting member is slidably connected to one of the first plurality of spaced support members through the slider element. To set a desired spacing between adjacent tine rows, the first and second tine row elements are simply shifted in unison along the base portion, with the slider element shifting along the one of the plurality of spaced support members and the first connecting member traveling within the channel.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
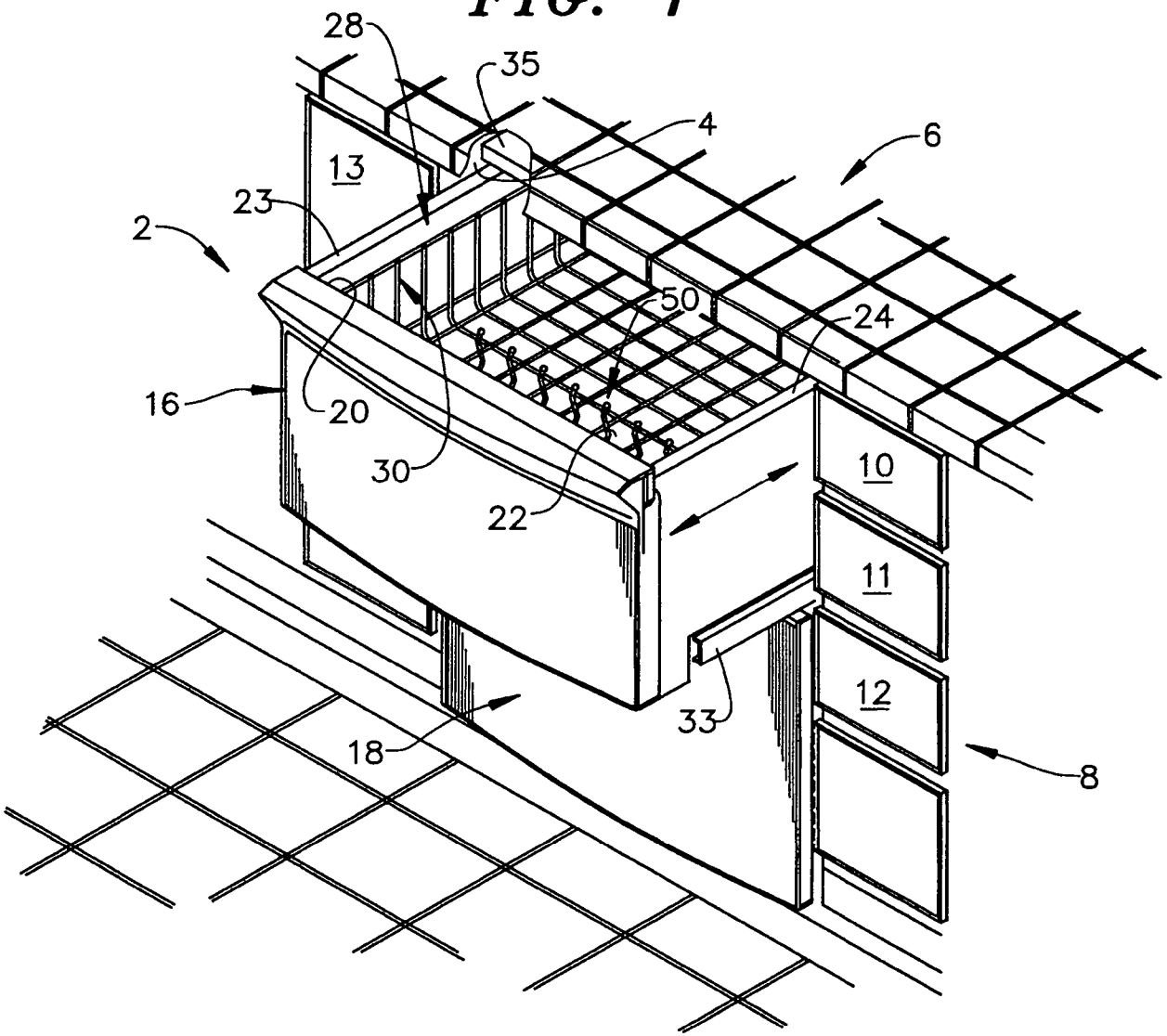
FIG. 1 is an upper right perspective view of a drawer-type dishwasher incorporating a sliding tine assembly constructed in accordance with the present invention.

With initial reference to FIG. 1, a dishwasher constructed in accordance with the present invention is generally indicated at 2. As shown, dishwasher 2 includes a support frame 4 arranged below a kitchen countertop 6. Also below kitchen countertop 6 is shown cabinetry 8 including a plurality of drawers 10-12, as well as a cabinet door 13. Although the actual dishwasher into which the present invention may be incorporated can vary, the invention is shown in connection with dishwasher 2 depicted as a dual cavity, drawer-type dishwasher having an upper washing unit 16 and a lower washing unit 18.

In the embodiment shown, both upper washing unit 16 and lower washing unit 18 take the form of slide-out tubs or drawer units. Preferably, washing units 16 and 18 are capable of independent or combined operation such that washing units 16 and 18 can be operated singly or both at the same time depending upon consumer preferences. Of course, it should be understood that, while shown as a dual cavity drawer type dishwasher, dishwasher 2 could take on various forms such as, for example, combination drawer/conventional dishwasher, a single drawer unit or a conventional type dishwasher. In any event, as each washing unit 16 and 18 is substantially identical, a more detailed description will be made with respect to washing unit or drawer 16 with an understanding that washing unit or drawer 18 has corresponding structure.

Drawer 16 includes a front wall 20, a rear wall (not shown), a bottom wall 22 and opposing side walls 23 and 24 that collectively define a wash chamber 28. In a manner that will be discussed more fully below, wash chamber 28 is provided with a dish rack 30 for supporting various objects, such as dishware, glassware, and the like, that are exposed to a washing operation. In a manner known in the art, drawer 16 is slidingly supported within support frame 4 through a pair of extensible glide rails, one of which is indicated at 33. Drawer 16 is also provided with a lid assembly 35 that is selectively raised and lowered to cover washing chamber 28. In general, the structure described above does not form part of the present invention and is provided for the sake of completeness. Instead, the present invention is directed to a sliding tine assembly 50 mounted to dishrack 30 in a manner that will be described more fully below.

Reference will now be made to FIGS. 2-5 in describing sliding tine assembly 50 constructed in accordance with a first embodiment of the present invention. Sliding tine assembly 50 includes a first tine row element 64 that is juxtaposed a second tine row element 65 both of which are slidably supported upon dish rack 30. More specifically, dish rack 30 includes a plurality of laterally spaced support members, one of which is indicated at 69, and a plurality of longitudinally spaced support members, one of which is indicated at 72, that form a latticework on dish rack 30. In the embodiment shown, first and second tine row elements 64 and 65 slide along the plurality of laterally spaced support members 69. In any case, as each tine row element 64, 65 is constructed substantially identically, a detailed description will be made with respect to tine row element 65 with an understanding that tine row element 64 is similarly constructed.

Figure 3:
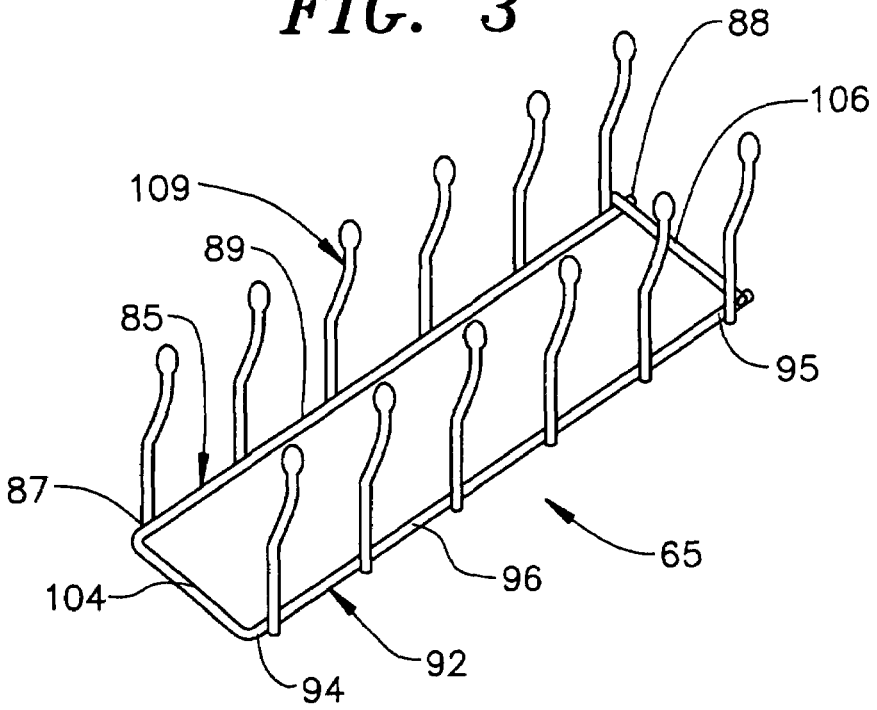
FIG. 3 is a perspective view of a tine row element portion of the sliding tine assembly of FIG. 2.

As best shown in FIG. 3, tine row element 65 includes a first rod member 85 having a first end portion 87 that extends to a second end portion 88 through an intermediate portion 89. Tine row element 65 also includes a second rod member 92 having a first end portion 94 that extends to a second end portion 95 through an intermediate portion 96. Preferably, first and second rod members 85 and 92 extend substantially parallel to one another and are joined through a first, U-shaped connecting member 104 positioned at first end portions 87 and 94, and a second connecting member 106 that interconnects second end portions 88 and 95. Actually, second connecting member 106 is slightly spaced from second end portions 88 and 95 towards intermediate portions 89 and 96 in the embodiment shown. In any event, each rod member 85, 92 is provided with a plurality of upstanding tine members, one of which is indicated at 109, for selectively positioning dishware, such as plates, platters, and the like, upon dish rack 30.

Figure 2:
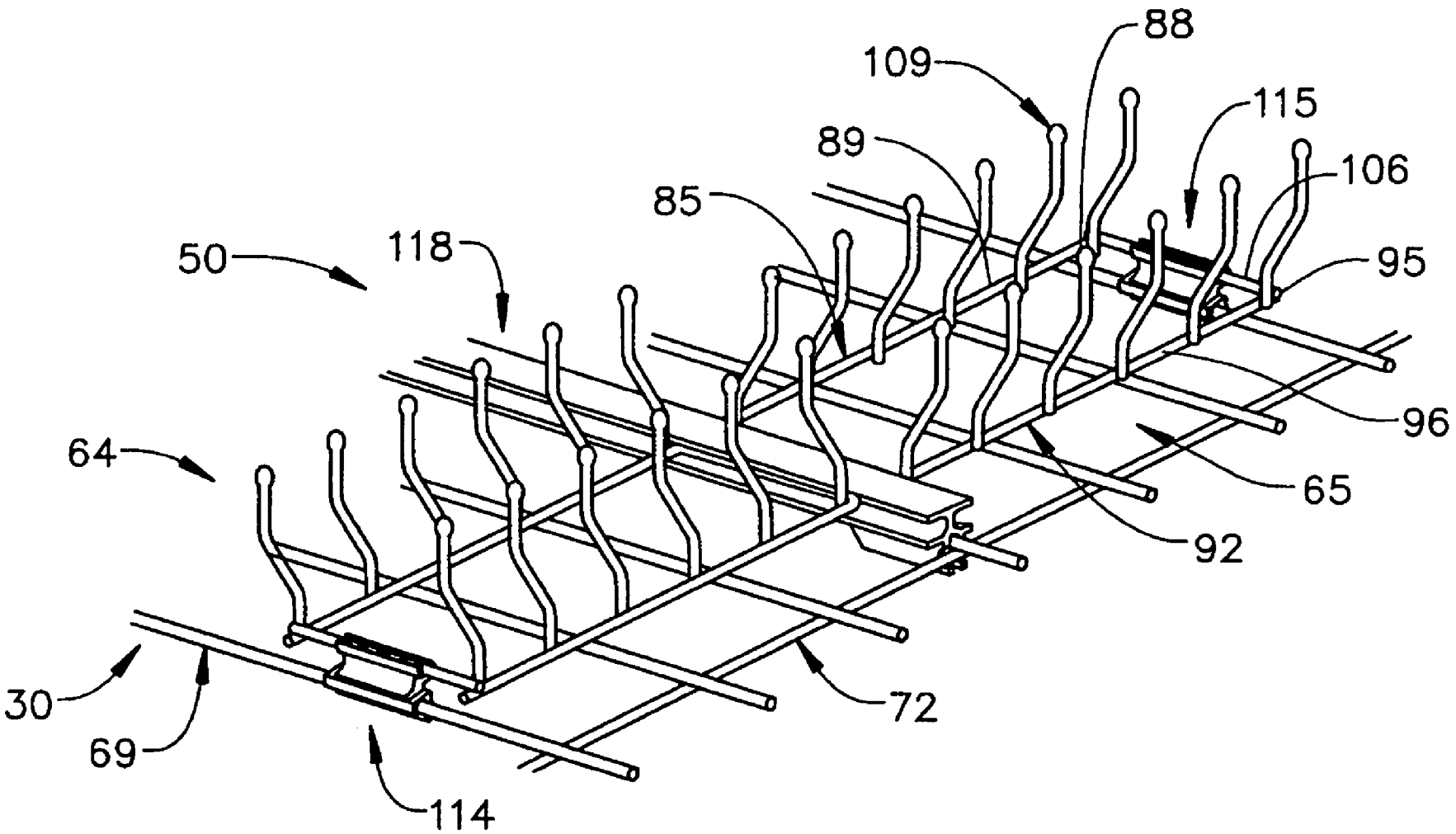
FIG. 2 is an upper right, partial perspective view of a sliding tine assembly constructed in accordance with a first embodiment of the present invention.

In accordance with the invention, first and second tine row elements 64 and 65 are slidably supported upon dish rack 30 through first and second slider elements 114 and 115 and a rail member 118 as shown in FIG. 2. Slider elements 114 and 115 interconnect corresponding ones of connecting members 106 to the longitudinally spaced support members 69, while rail member 118 slidably receives corresponding ones of U-shaped connecting members 104 in a manner that will be described more fully below. In any event, as each slider element 114, 115 is similarly constructed, a detailed description will be made with reference to slider element 115 with an understanding that slider element 114 is identical.

Figure 4:
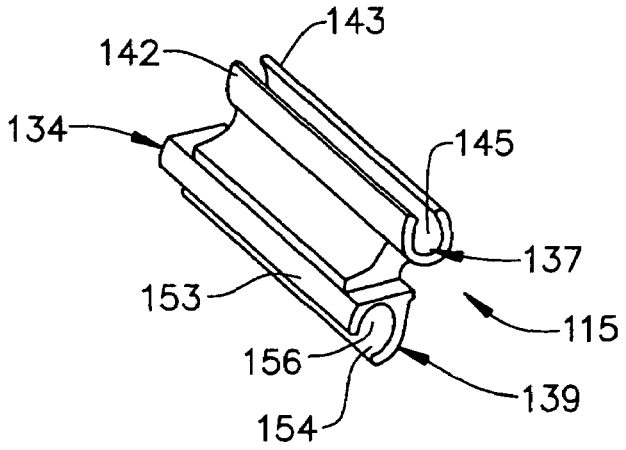
FIG. 4 is a perspective view of a slider element constructed in accordance with the first embodiment of the present invention.

As best shown in FIG. 4, slider element 115 includes a main body portion 134 having an upper tine element engaging section or tine clip 137 and a lower rack engaging section 139. Tine element engaging section 137 includes first and second ear portions 142 and 143 that define a central arcuate cavity 145. First and second ear portions 142 and 143 snugly retain connecting member 106 within arcuate cavity 145 through a snap-fit engagement. In a similar manner, rack engaging section 139 includes first and second clip elements 153 and 154 that define a central arcuate notch 156 that both snap-fittingly and slidingly engages with one of the plurality of laterally spaced support members 69. More specifically, while tine element engaging section 137 is designed to fixedly retain tine row element 65, first and second clip elements 153 and 154 are designed to engage with one of the plurality of laterally spaced support members 69 in such a way so as to allow shifting relative to dish rack 30.

Figure 5:
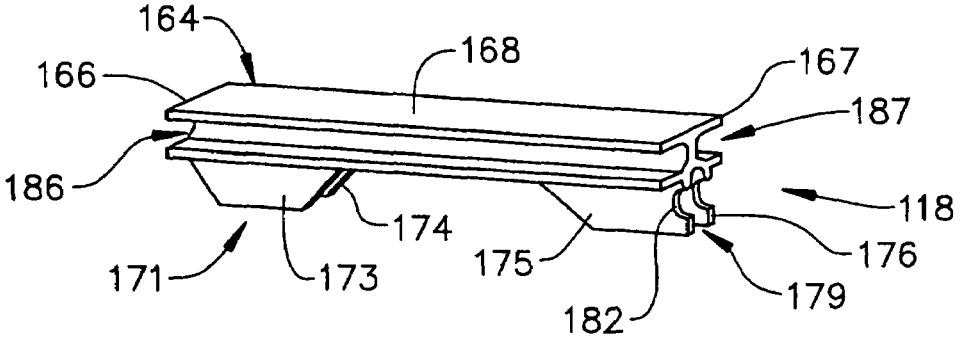
FIG. 5 depicts a rail member portion of the sliding tine assembly constructed in accordance with the first embodiment of the present invention.

Referring to FIG. 5, rail member 118 includes a main body portion 164 having a first end 166 that extends to a second end 167 through an intermediate portion 168. Rail member 118 includes a rack engaging clip 171 that extends downward from main body portion 164 and is configured to engage with another one of the plurality of laterally spaced support members 69. Towards that end, rack engagement clip 171 includes first and second ear elements 173 and 174 positioned at first end 166, as well as third and fourth ear elements 175 and 176 positioned at second end 167. First and second ear elements 173 and 174, as well as third and fourth ear elements 176 and 177, are spaced one from the other so as to define a channel, indicated at 179, that extends longitudinally along rail member 118. In addition, each of third and fourth ear elements 175 and 176 is shown to include a notch 182 that is designed to receive one of the plurality of longitudinally spaced support members 72 to fixedly position rail member 118 relative to dish rack 30. At this point, it should be understood that, while the rack engaging clip 171 is shown to include corresponding pairs of spaced ear elements 173, 174 and 175, 176, various other configurations and geometries can also be employed, such as a single pair of spaced ear elements that extend along the entire length of rail member 118.

In any event, regardless of the particular construction, rail member 118 includes a pair of longitudinal channels or guide tracks 186 and 187 formed in main body portion 164. Channels 186 and 187 are positioned so as to receive each U-shaped connecting member 104 of respective ones of tine row elements 64 and 65. In this manner, with each second connecting member 106 being supported by a slider element 114, 115, each U-shaped connecting member 104 is slidingly supported within corresponding ones of channels 186 and 187, allowing tine row elements 64 and 64 to slide laterally along dish rack 30. For instance, tine row element 64 can slide with connecting member 104 shifting relative to channel 186 and slider element 114 shifting along a support member 69 of dish rack 30. Thus, a consumer can selectively alter a spacing of adjacent tine rows to enhance an overall configurability of dishrack 30 so as to efficiently utilize the available space.

Figure 6:
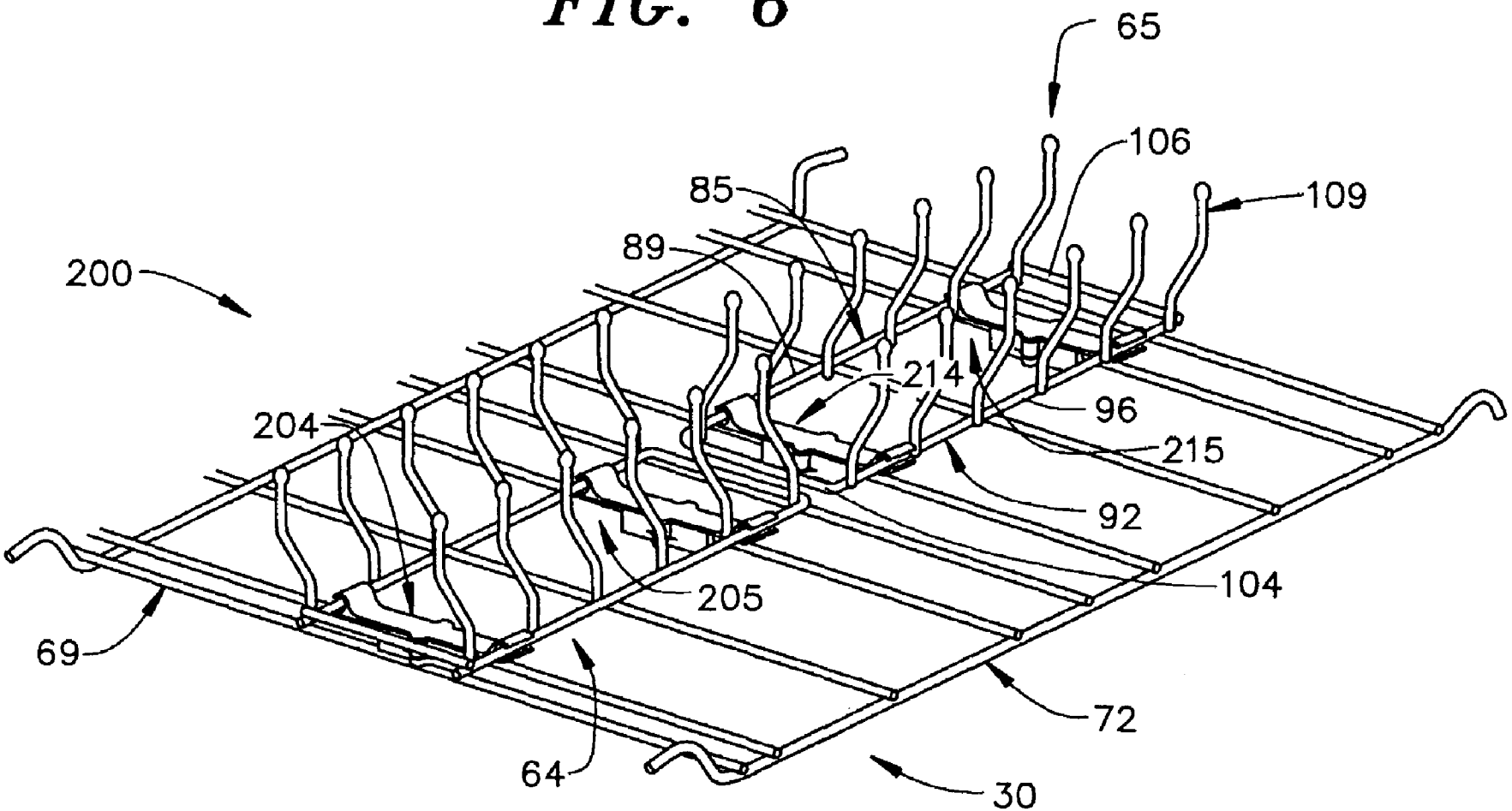
FIG. 6 is an upper left perspective view of a sliding tine assembly constructed in accordance with a second embodiment of the present invention.
Figure 7:
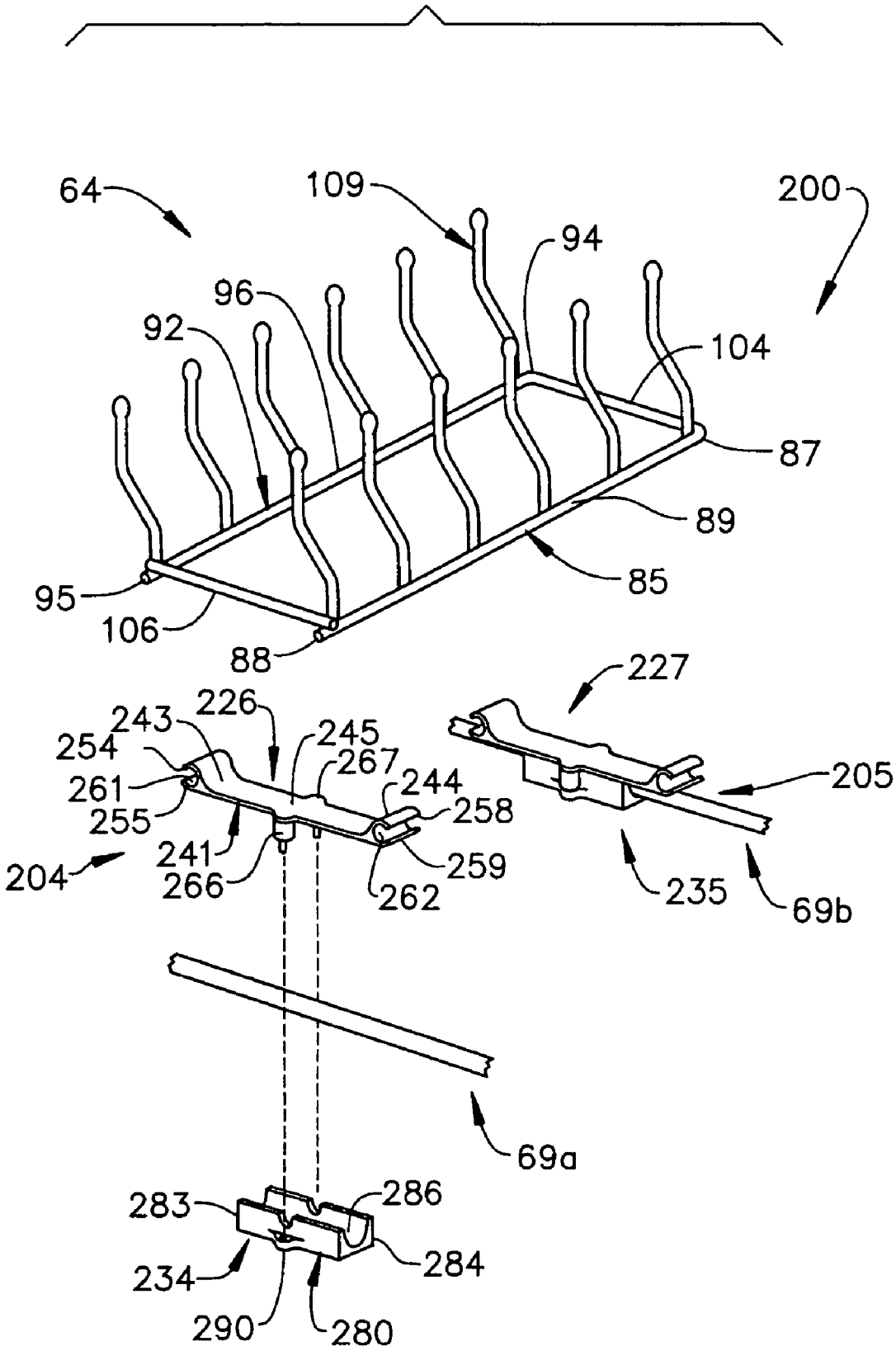
FIG. 7 is an exploded view of the sliding tine assembly of FIG. 6.

Reference will now be made to FIGS. 6 and 7, wherein like reference numbers represent corresponding parts in the respective views, in describing a sliding tine assembly 200 constructed in accordance with a second embodiment of the present invention. As best shown in FIG. 6, first and second tine row elements 64 and 65 are slidably supported by dish rack 30 through corresponding pairs of slider elements 204, 205 and 214, 215. As each slider element 204, 205 and 214, 215 is similarly constructed, a detailed discussion will focus on slider elements 204 and 205, with a particular emphasis on slider element 204, and it is to be understood that the remaining slider elements 214 and 215 are substantially identically formed.

As best shown in FIG. 7, slider elements 204 and 205 include respective upper tine element engaging portions or tine clips 226 and 227 and lower rack engaging portions 234 and 235. Tine element engaging portions 226 and 227 are designed to interconnect with tine row element 64 while rack engaging portions 234 and 235 are designed to connect with corresponding ones of the plurality of laterally spaced support members 69*a* and 69*b* and corresponding ones of tine element engaging portions 226, 227 in a manner that will be discussed more fully below. In any event, tine element engaging portion 226 is shown to include a main body portion 241 having a first end section 243 that extends to a second end section 244 through an intermediate section 245. First and second end sections 243 and 244 are provided with respective first and second clip portions 254, 255 and 258, 259, each of which defines a corresponding arcuate section 261, 262 that snap-fittingly engages with tine row element 64. In addition, tine element engaging portion 226 is provided with a pair of pin members 266 and 267 that extend laterally outward and downward from intermediate portion 245 and are adapted to connect with rack engaging portion 234.

As also shown in FIG. 7, rack engaging portion 234 includes a main body portion 280 having first and second end sections 283 and 284 that define an arcuate intermediate section 286. Rack engaging portion 234 also includes a pair of pin receiving elements, one of which is indicated at 290, that extend laterally outward from main body portion 280. Pin receiving elements 290 are configured to engage with respective ones of pin members 266 and 267, with one of the plurality of laterally spaced support elements 69*a* positioned within arcuate intermediate section 286. Of course, it should be understood that the particular fit within arcuate intermediate section 286 provides for some clearance thereby allowing shifting along laterally spaced support member 69. It should be understood that mechanical fasteners could be employed to join tine element engaging portion 226 to rack engaging portion 234. In any case, once tine row engaging portions 226 and 227 are connected to tine row element 64 and rack engaging portions 234 and 235 respectively, tine row element 64 can be selectively shifted along dish rack 30 to enable a consumer to establish a desired configuration to make efficient use of available space for loading dishware and the like within dishwasher 2.

Figure 8:
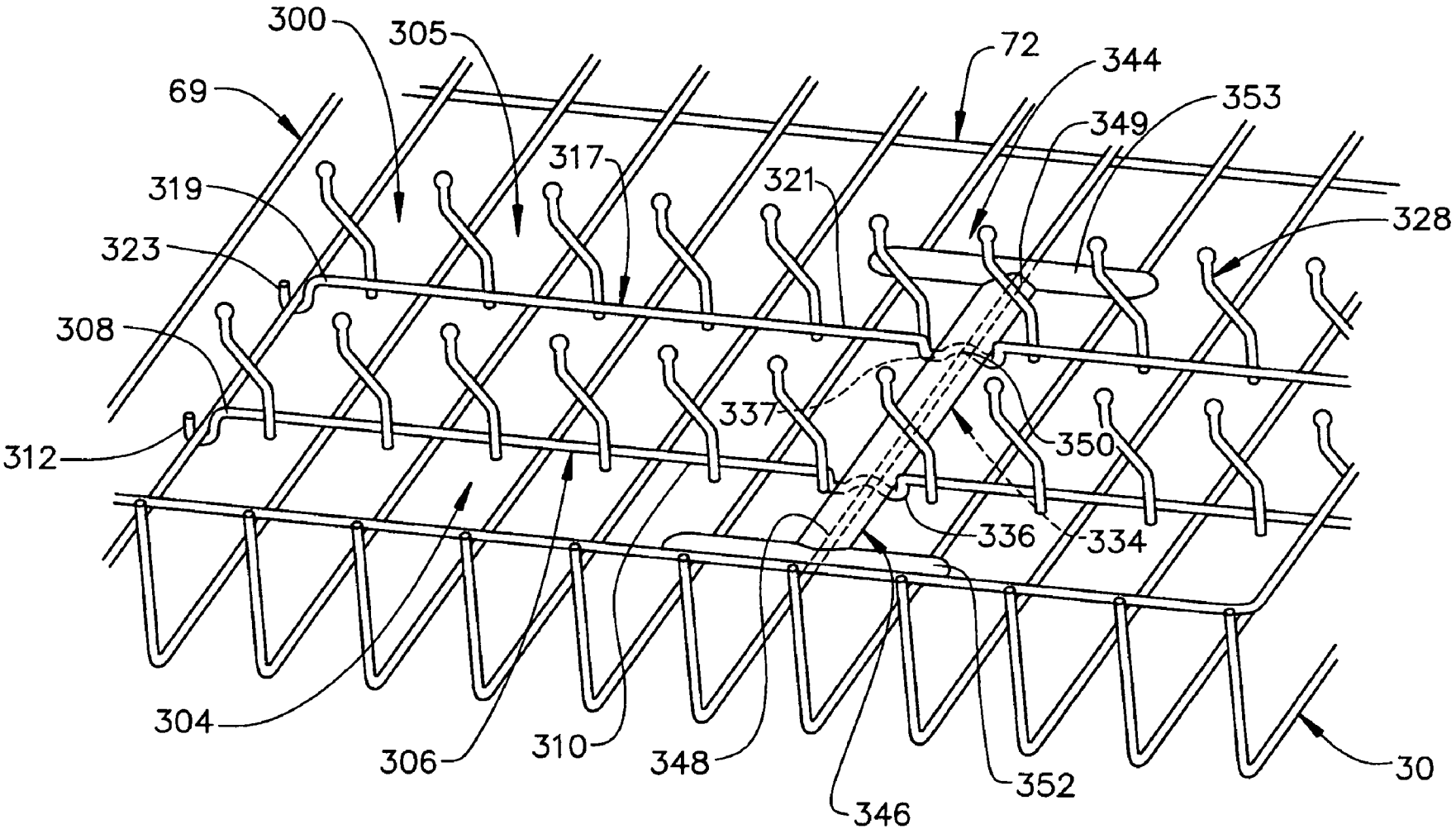
FIG. 8 is an upper right perspective view of a sliding tine assembly constructed in accordance with a third embodiment of the present invention.

At this point, reference will be made to FIG. 8 in describing a sliding tine row assembly 300 constructed in accordance with a third embodiment of the present invention. As shown, sliding tine row assembly 300 includes first and second tine row elements 304 and 305. Tine row element 304 includes a rod member 306 including a first end portion 308 that extends to a second end portion (not shown) through an intermediate portion 310. Preferably, first end portion 308 includes a guide element such as a slider or hook 312 that loops about one of the plurality of laterally spaced support members 69. Of course, it should be understood that the second portion (not shown) includes a corresponding slider or hook. Tine row element 305 also includes a rod member 317 having a first end portion 319, a second end portion (not shown) and an intermediate portion 321. In a manner similar to that described above, first end portion 319 terminates in a slider or hook 323 that loops about one of the plurality of laterally spaced support member 69. Again, it should be noted that second end portion (not shown) of second rod member 317 is also preferably provided with a corresponding hook that cooperates with another one of the plurality of laterally spaced support member 69.

In any case, each rod member 306, 317 is provided with a plurality of upstanding tine members, one of which is indicated at 328, for supporting plates, platters and the like upon dish rack 30. In addition, first rod members 306 and 317 are interconnected by a connecting member 334. Actually, connecting member 334 interconnects rod members 306 and 317 at respective intermediate portions 310 and 321. More specifically, each intermediate portion 310, 321 includes a notch 336, 337 which, in a manner that will be described more fully below, receives a slider element 344.

More specifically, slider element 344 rests upon notches 336 and 337 and is joined to connecting member 334 through a clip element (not shown) such as that provided on slider elements 119 and 115. Of course, various other sliding attachment techniques could also be employed. Slider element 334 includes a main body portion 346 having a first end 348, a second end 349 and an intermediate portion 350, with the clip element (not shown), such as employed on sliding elements 114 and 115, provided on an underside of intermediate portion 350. Slider element 344 also includes a pair of rack engaging members 352 and 353 that are provided at first and second end portions 348 and 349 respectively. Rack engaging members 352 and 353 also include corresponding clip elements (not shown) that connect with two of the plurality of laterally spaced support members 69 of dish rack 30. With this configuration, tine row element 304 can be repositioned upon dish rack 30 by simply sliding slider element 344 along laterally spaced support members 69. Hooks 312 and 323 provide additional support for the opposing end sections of tine row assembly 300 to ensure a smooth transition. In any event, tine row assembly 300 can be slidably shifted relative to dish rack 30 in a manner analogous to the other embodiments described above.

At this point, it should be understood that the present invention allows for the simple construction of adjustable or sliding tine row assembly that can be incorporated into a dish rack of a dishwasher to allow a consumer to establish a desired configuration when loading dishware. More specifically, the sliding tine row assembly can be incorporated into a new or existing dishrack to provide a consumer with the ability to optimize space within the dishrack when positioning dishware to be exposed to a washing operation. Although described with reference to preferred embodiments of the invention, it should be readily understood that various changes and/or modifications can be made to the invention without departing from the spirit thereof. For instance, the particular configuration of tine element engaging portions and rack engaging portions could be varied so as to have various geometries. Also, the dishrack could include multiple sliding tine row assemblies. Again, while shown in connection with a drawer-type dishwasher, the sliding tine assembly could also be incorporated into various dishwasher models. Finally, it should be understood that the dishrack and/or the tine row assemblies could be formed from coated wire, reinforced plastic or other suitable material. In general, the invention is only intended to be limited by the scope of the following claims.

We claim:

1. A dishwasher comprising:

a tub defining a wash chamber; and a dishrack arranged within the washing chamber for supporting dishware to be exposed to a washing operation, said dishrack including:

a base portion including a plurality of laterally spaced support members; and a tine row assembly positioned in the dishrack, said tine row assembly including a first tine row element, a second tine row element, and a slider element attached to the first and second tine row elements and the dishrack such that the first and second tine row elements are selectively shiftable along the base portion of the dishrack.

2. The dishwasher according to claim 1, wherein each of the first and second tine row elements includes a first end portion, a second end portion and an intermediate portion, said first and second tine row elements being joined through a connecting member.

3. The dishwasher according to claim 2, wherein the dishrack includes a first plurality spaced support members extending laterally across the base portion and a second plurality of spaced support members extending longitudinally across the base portion, said first and second plurality of spaced support members intersecting across the base portion.

4. The dishwasher according to claim 3, wherein the tine row assembly is slidably mounted to at least one of the first plurality of spaced support members.

5. The dishwasher according to claim 3, further comprising: a guide element provided on each of the first and second ends of the first and second tine row elements.

6. The dishwasher according to claim 5, wherein the guide element is constituted by a hook.

7. The dishwasher according to claim 5, wherein the slider element is attached to the intermediate portion of each of the first and second tine row elements.

8. The dishwasher according to claim 1, wherein each of the first and second tine row elements includes a first end portion, a second end portion and an intermediate portion, said first end portions being joined by a first connecting member and said second end portions being joined by a second connecting member.

9. The dishwasher according to claim 8, wherein the slider element includes a rack engaging portion and a tine element engaging portion, said tine element engaging portion being connected to the first and second tine row members and said rack engaging portion being connected to the tine element engaging portion and the base portion of the dishrack.

10. The dishwasher according to claim 9, wherein the tine element engaging portion snap-fittingly engages one of the first and second connecting members.

11. The dishwasher according to claim 8, wherein the tine row assembly further includes a rail member attached to the base portion of the dishrack, said rail member including a first end portion, a second end portion and an intermediate portion, said intermediation portion including a channel.

12. The dishwasher according to claim 11, wherein the slider element is connected to the first connecting member.

13. The dishwasher according to claim 11, wherein the second connecting member is adapted to nest within the channel of the rail member.

14. The dishwasher according to claim 13, wherein the rail member includes first and second channels formed in the intermediate portion, said first channel being arranged directly adjacent the second channel on opposing sides of the rail member.

15. The dishwasher according to claim 1, wherein the dishrack includes first and second tine row assemblies adapted to be selectively shifted along the base portion.

16. The dishwasher according to claim 15, wherein the first tine row assembly is juxtaposed the second tine row assembly.

17. A method of adjusting a tine row assembly slidingly supported upon a dishrack including a plurality of laterally spaced support members comprising:

attaching first and second interconnected tine row elements to at least two of the plurality of laterally spaced support members provided on a base portion of the dishrack through a slider element; and adjusting the first and second tine row elements by sliding the first and second tine row elements relative to the dishrack.

18. The method of claim 17, further comprising:

shifting in the first and second tine row elements in unison relative to the dishrack.

19. The method of claim 18, further comprising:

attaching a rail member, including a channel, to the base portion of the dishrack; and supporting a connecting member, which joins the first and second tine row elements, in the channel, wherein adjusting the first and second tine row elements includes sliding the tine row assembly along the channel.

20. The method of claim 17, further comprising:

snap-fittingly engaging the slider element to at least one of the first and second tine row elements and the base portion; and adjusting the first and second tine row elements by sliding the slider element along the base portion.

* * * * *